United States Patent [19]

Cunningham et al.

[11] 4,016,064

[45] Apr. 5, 1977

[54] DIAPHRAGM CELL CATHODE STRUCTURE

[75] Inventors: Hugh Cunningham; Carl W. Raetzsch; George L. Rich; John D. Driskill, all of Corpus Christi, Tex.

[73] Assignee: PPG Industries, Inc., Pittsburgh, Pa.

[22] Filed: Nov. 28, 1975

[21] Appl. No.: 636,019

[52] U.S. Cl. ..... 204/256

[51] Int. Cl.[2] ..... C25B 9/00

[58] Field of Search ..... 204/254–256; 29/200 R

[56] References Cited

UNITED STATES PATENTS

| | | | |
|---|---|---|---|
| 3,337,443 | 8/1967 | Raetzsch et al. | 204/254 X |
| 3,902,984 | 9/1975 | Yoshida et al. | 204/254 |

*Primary Examiner*—C. F. LeFevour
*Attorney, Agent, or Firm*—Richard M. Goldman

[57] ABSTRACT

Disclosed is an electrolytic diaphragm cell having a plurality of fingered anode blades extending outwardly from an anode base plate and cathode means that are electrically and mechanically connected to a cathode base plate that is parallel to and spaced from the anode base plate. The cathode means include a cathode back screen spaced from and parallel to the cathode base plate, and a plurality of hollow cathode fingers extending outwardly from the cathode back screen, and interleaved between the anode blades. Each of the cathode fingers has an open base and side walls, a top, a bottom, and a leading edge fabricated of foraminous metal. The individual cathode fingers have bolt means electrically and mechanically connected to each of the cathode fingers, and extending outwardly from the open end thereof. The bolt means pass through apertures in the cathode back screen corresponding to but of greater diameter than the bolt means so that the individual cathode fingers are slideably adjustable on the cathode back screen. Electrical contact between the cathode base plate and the cathode unit is provided by first elastic conductor means which extend outwardly from the cathode base plate toward the cathode back screen, and second elastic conductor means in electrical contact with the first elastic conductor means and in electrical and mechanical contact with the bolt means on the opposite side of the cathode back screen from the cathode fingers. Also disclosed is a method of assembling the cell by inserting the individual cathode fingers between adjacent individual anodes such that the bolt means project outwardly from the open base, positioning the cathode back screen on a plane substantially defined by the open edges of the individual finger cathodes while allowing the bolt means to pass through apertures in the cathode back screen. The elastic conductor means are then placed on the bolt means on the opposite side of the back screen from the cathodes. The elastic conductor means, the bolt means, and the cathode back screen means are then fastened together; and the anode unit and the cathode unit are assembled together so as to form a single electrolytic diaphragm cell.

10 Claims, 5 Drawing Figures

DIAPHRAGM CELL CATHODE STRUCTURE

DESCRIPTION OF THE INVENTION

Bipolar electrolyzers offer significant economies of construction and operation. Bipolar electrolyzers are characterized by a backplate, also known as a bipolar unit or bipolar electrode. The backplate serves as a common structural member supporting the cathodes of one cell of a bipolar electrolyzer and the anodes of the next adjacent cell of the bipolar electrolyzer.

The backplate further serves as means of conducting electrical current from the cathode of one cell in the electrolyzer through the backplate to the anodes of the next adjacent cell in the electrolyzer. The backplate is electrolyte impermeable so as to prevent mixing of the catholyte liquor of one cell and the anolyte liquor of the next adjacent cell of the electrolyzer.

An individual cell of the bipolar electrolyzer is defined by the anode unit of one bipolar electrode and the cathode unit of the next adjacent bipolar electrode. The cathodes are electrolyte permeable and covered with a permeable barrier such as a diaphragm, a permionic membrane, or an ion exchange membrane. The diaphragm divides the cell into a catholyte chamber and an anolyte chamber.

In the operation of a bipolar electrolyzer, brine is fed into each of the separate cells and an electrical potential is imposed across the electrolyzer. The electrical potential causes current to flow from a power supply to an anodic end unit and from the anodic end unit of the electrolyzer to the individual cells thereof, in series, to a cathodic end unit and then back to the power supply or to an adjacent bipolar electrolyzer.

Chlorine is recovered from the individual anolyte chambers of the electrolyzer while hydrogen gas and cell liquor are recovered from individual catholyte chambers of the electrolyzer. The feed to the cell is saturated brine which may be saturated, or maintained at an elevated temperature and saturated with respect to the elevated temperature. Typically, the brine is saturated brine containing from about 300 to 325 grams per liter of sodium chloride.

The catholyte cell liquor product contains approximately 120 to 225 grams per liter of sodium chloride and from about 110 to 150 grams per liter of sodium hydroxide.

Where a permionic membrane is used rather than a diaphragm as the permeable barrier between the anolyte chamber and the catholyte chamber of the cell, the catholyte cell liquor may contain up to 300 or more grams per liter of sodium hydroxide and considerably lesser amounts, e.g., less than about 80 grams per liter, of sodium chloride and most frequently less than about 10 grams per liter of sodium chloride.

While bipolar cells offer economies of operation relative to monopolar cells, the high costs of power have necessitated narrower anode to cathode gaps. This is to reduce the resistance loss ($I^2R$) power loss that results in heating of the electrolyte. Furthermore, more rugged diaphragms, such as those that contain both asbestos and organic resins or resins alone, allow narrower anode to cathode gaps without fear of actually burning holes in the diaphragm. However, these narrower gaps permit less tolerance in the location of electrical contact and mechanical supports for the anodes and cathodes depending from a backplate. The reduced tolerances result in a higher fabrication cost. For example, where the cathodes of one bipolar unit are interleaved with the anodes of another bipolar unit, a 1/16 inch tolerance in an electrolytic cell having a ⅛ inch interelectrode gap could easily result in abrasion of the diaphragm or permionic membrane off of the cathode.

Moreover, a reduced gap between adjacent cathodes makes diaphragm quality control more difficult. That is, as the interelectrode gap is reduced it becomes more difficult to inspect the installed diaphragm or even to carefully monitor and control the installation of the diaphragm.

It has now been found that if each cathode finger is assembled individually, that is, if a diaphragm is separately installed on each individual cathode finger and the cathode fingers are then inserted between the anode blades so that the anodes themselves set the spacing and alignment of the cathodes in a particular individual electrolytic cell, the fabrication tolerances are no longer as critical as for a cell of like interelectrode gap and electrode dimensions where the electrodes depend directly to the backplate.

After the cathode fingers are inserted between the anode blades so that the anodes themselves set the alignment, and the cathodes are in position, the back screen may be installed over the cathodes and then the cathode fingers and the conductors may be joined to the cathode back screen. In this way, an electrolytic cell may be provided of narrow interelectrode gap but reasonably attainable fabrication tolerances.

THE FIGURES

DETAILED DESCRIPTION OF THE INVENTION

The structure described herein is directed to a diaphragm electrolytic cell having a plurality of fingered anode blades. The fingered anode blades extend outwardly from an anode base plate. The diaphragm electrolytic cell further includes cathode means that are electrically and mechanically connected to a cathode base plate. The cathode base plate is parallel to and spaced from the anode base plate. The cathode means include a cathode back screen that is spaced from and parallel to the cathode base plate and individual hollow cathode fingers. The individual hollow cathode fingers extend outwardly from the cathode back screen and are interleaved between anode blades of the electrolytic diaphragm cell. Each of the cathode fingers has an open base, side walls, a top, a bottom, and a leading edge which are fabricated of a foraminous metal.

This invention is particularly directed to a diaphragm electrolytic cell where the cathode means includes bolt means that are electrically and mechanically connected to each of the cathode fingers and extend outwardly from the open end or base thereof. The bolt means pass through apertures in the cathode back screen which apertures correspond to the bolt means but are a greater diameter than the bolt means so that the cathode fingers are slideably adjustable on the cathode back screen. Further included are first elastic conductor means extending outwardly from the cathode base plate toward the cathode back screen and second elastic electrical conductor means that are in electrical contact with the bolt means on the opposite side of the cathode back screen from the cathode fingers. The first electrical conductor means and the second electrical conductor means are in electrical contact with each other.

Figure 1:
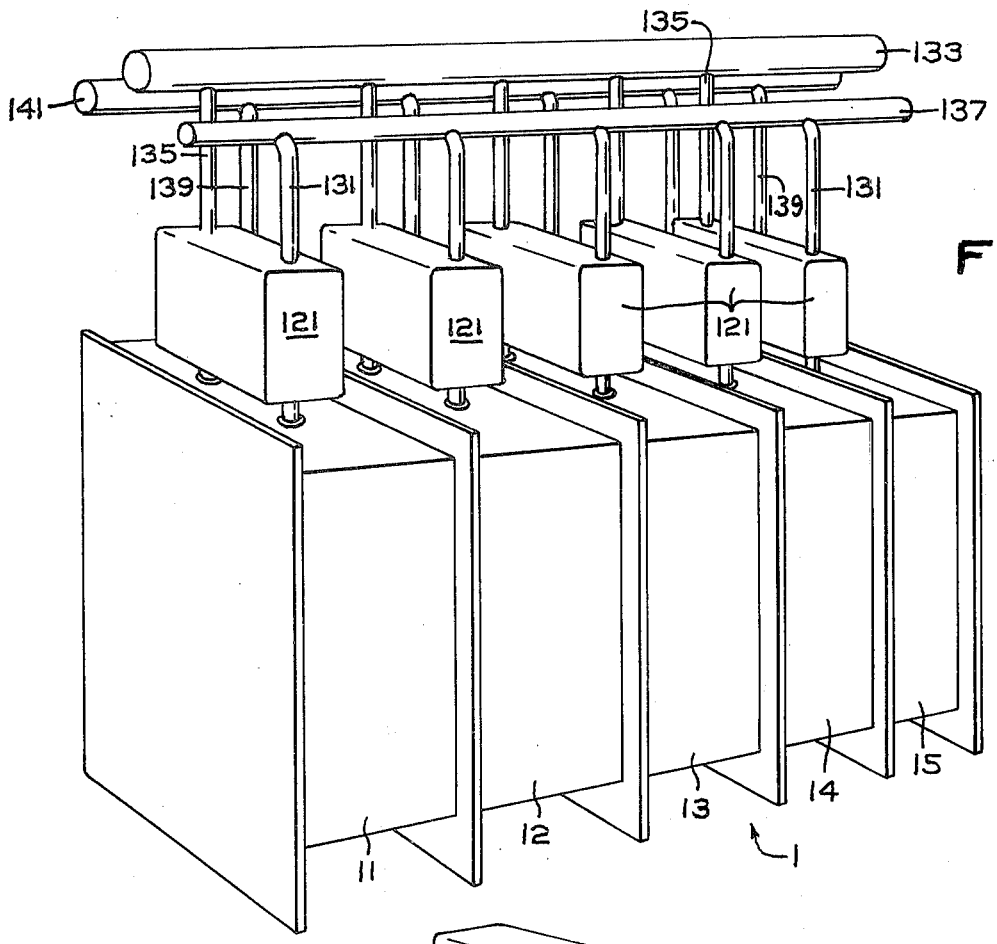
FIG. 1 is a perspective view of a bipolar electrolyzer.
Figure 2:
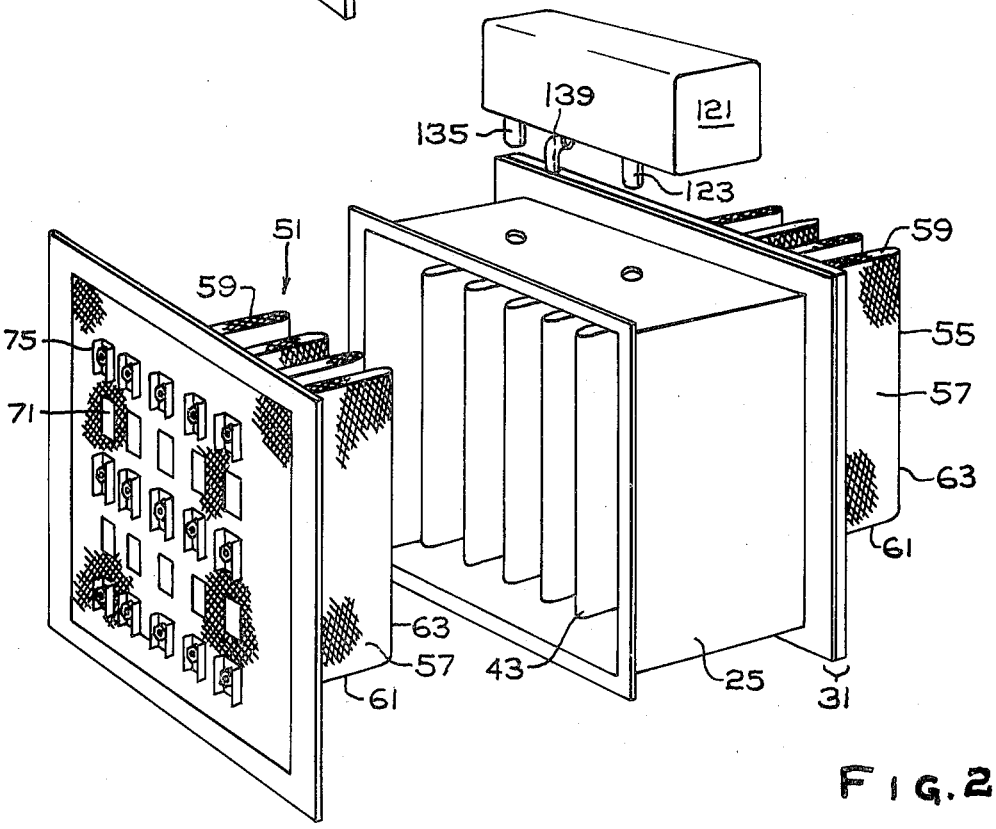
FIG. 2 shows an exploded perspective view of a cathode unit having a cathode back screen with cathode fingers and of the next bipolar unit having anodes, backplate, and cathode unit.
Figure 3:
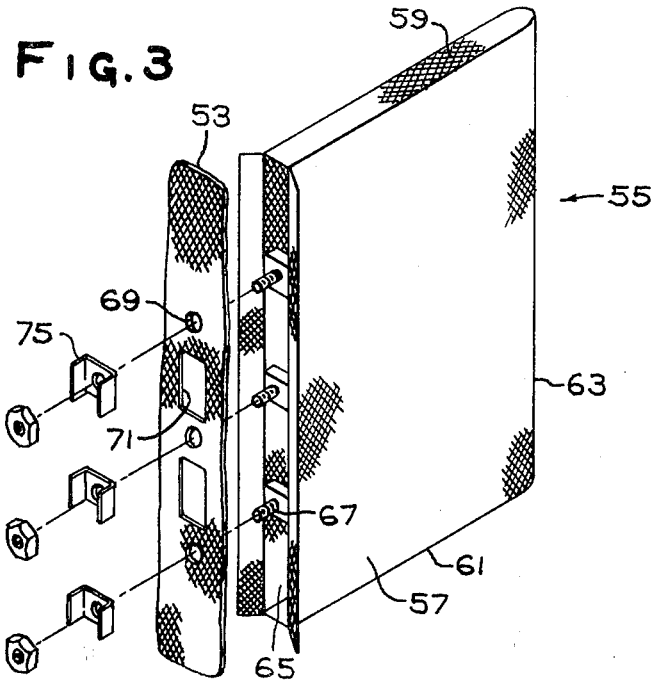
FIG. 3 shows a cathode, a segment of the back screen, the clips, and the bolt means in exploded perspective.
Figure 4:
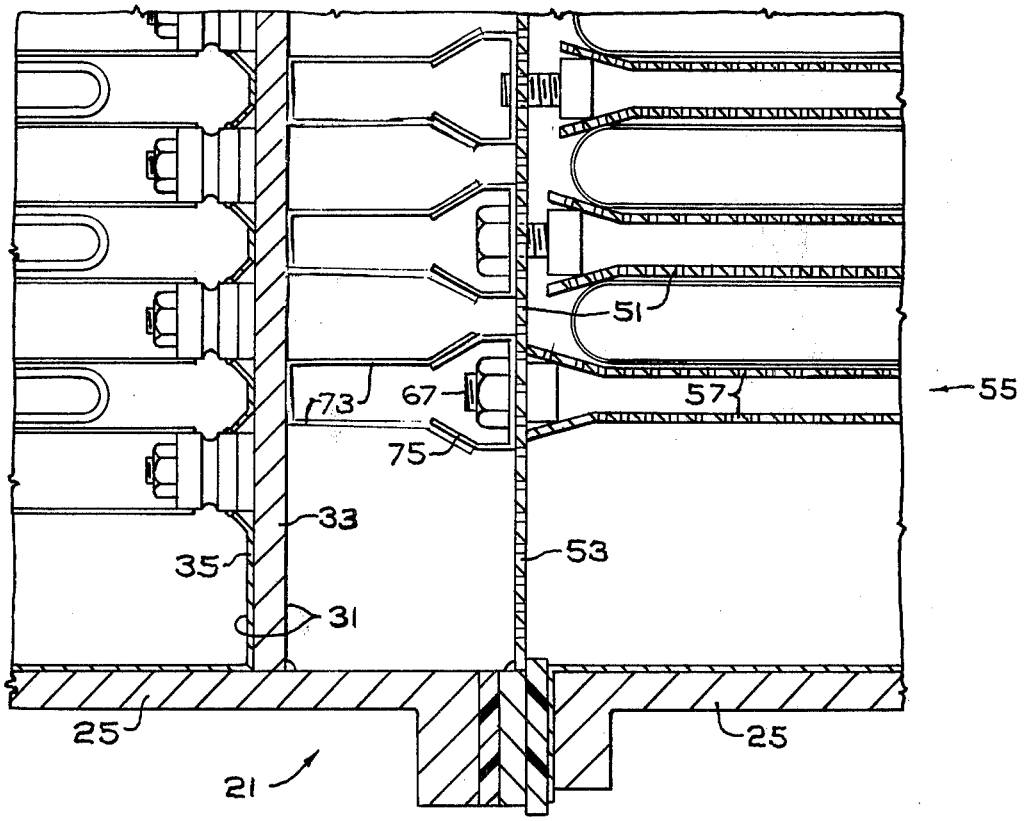
FIG. 4 is a cutaway view of a bipolar unit showing the anodes, the backplate, and the cathode unit.
Figure 5:
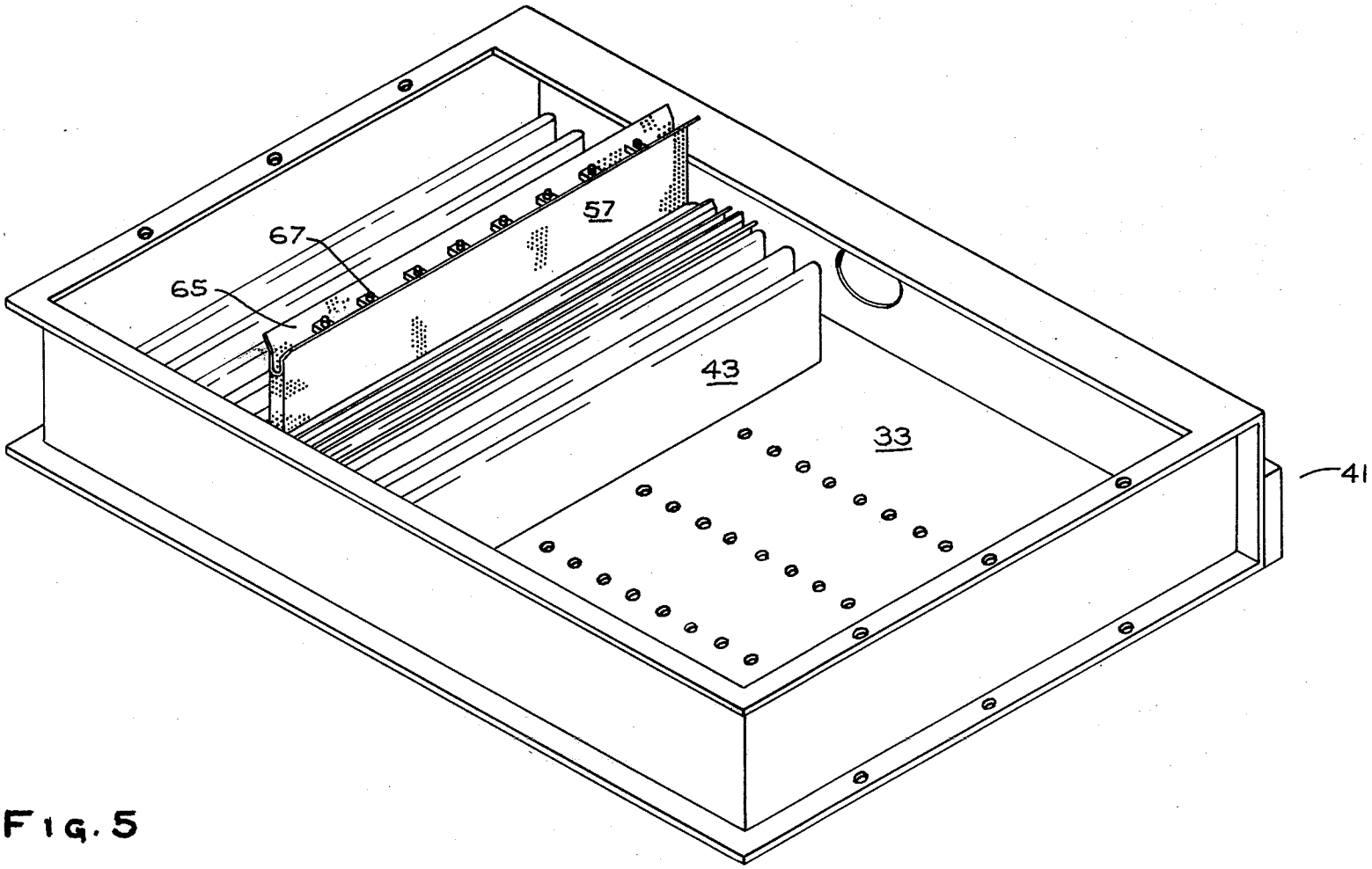
FIG. 5 shows a method of assembly where a cathode is interleaved between a pair of anodes in an anode unit.

Although the structure and method of this invention are useful in monopolar electrolytic diaphragms, the cathode structure of this invention is particularly useful in bipolar electrolytic cells and will be described with respect thereto. Such an electrolyzer is shown in FIGS. 1 and 2 where a single common structural member 31, that is, a backplate, provides the cathodes 51 of one cell in the bipolar electrolyzer and the anodes 41 of the next adjacent cell in the electrolyzer.

A bipolar electrolyzer 1 has a plurality of individual electrolytic cells 11, 12, 13, 14, 15 electrically and mechanically in series. Brine is fed to each cell from a brine header 133 through brine lines 131 to a brine box 121 to and through lines 123 and 125 to the anolyte compartments of the individual cells 11, 12, 13, 14, 15. Within the anolyte chamber, chlorine is generated at the anodes and passed upward through lines 123 and 125 to the brine box 121 and from the brine box 121 through chlorine line 135 to the chlorine header 137. Anolyte liquor passes through the diaphragm to the catholyte chamber where hydrogen is liberated at the cathode and recovered through hydrogen lines 139 to hydrogen header 141, and catholyte liquor is recovered through a perc pipe.

The cathode structure includes individual hollow cathode fingers 55 that are of sufficient strength to be capable of supporting a diaphragm. The hollow cathode fingers have side walls 57, a top edge 59, a bottom edge 61, and a leading edge or tip 63, that are formed of a suitable metal. A suitable metal is an electroconductive, electrolyte impermeable metal in an electrolyte permeable form. The electrolyte permeable form may be provided by a perforated plate, perforated sheet, metal mesh, or expanded metal mesh, so as to provide an open area of from about 30 percent to about 70 percent.

The material of construction for the cathode may be iron or iron alloys such as steel or a mild low-carbon steel. Additionally, the cathode may have hydrogen overvoltage reducing catalysts or depolarizing agent thereon.

The cathode finger 55 is open at the base 65 where the cathode finger 55 joins with the back screen 53 to form a catholyte chamber. By open is meant that there is no diaphragm at the base 65 of the cathode finger 55 and that there is substantial absence of metal mesh, perforated plate, or the like, so as to allow the unimpeded flow of catholyte liquor and hydrogen gas.

Extending outwardly from the open base 65 of the cathode finger 55 is bolt means 67. The bolt means are preferably threaded bolt means of a suitable electroconductive material such as copper, iron, or the like. The diameter of the bolt means is from about 3/16 inch to about 5/16 inch.

The bolt means 67 is electrically and mechanically joined to the cathode. For example, the bolt may be welded to the cathode walls 57 by tap welding, spot welding, or the like. Alternatively, the bolt means 67 may be welded to a stud which is in turn welded to the walls 57 of the cathode finger 55.

The cathode back screen 53 is substantially parallel to and spaced from the cathode backplate 33. The cathode back screen 53 is substantially coextensive with the backplate 31. It is fabricated of the same materials as the cathode fingers in the same form. That is, it may be formed of an electroconductive, electrolyte impermeable metal in an electrolyte permeable structure such as perforated plate, perforated sheet, metal mesh, or expanded metal mesh having from 30 to 70 percent open area. The material itself may be iron or an iron alloy, such as steel or low-carbon mild steel.

The back screen typically has two types of apertures therein. The first type of aperture 69 corresponds to the bolt means and is of a diameter sufficiently greater than the diameter of the bolt means 67 to allow for the movement, for example, the slideable movement, of the cathode fingers 55 and yet close enough in size to the diameter of the bolt means 67 to allow the bolt means 67 to be fastened thereto. Typically, the diameter of the first apertures is from about ¼ inch to about ½ inch greater than the diameter of the bolt means 67. The second apertures 69 are those having a large enough diameter to allow the unimpeded passage of cell liquor and hydrogen gas between the hollow interiors of the cathode fingers 55 and the volume between the cathode back screen 53 and the cathode base plate 33 and of small enough size to support a diaphragm between the ends of the cathode walls 57 and edges of the back screen 53.

Electrical contact between the cathode backplate 33 and the individual hollow cathode fingers 55 is provided by a system of first and second flexible, elastic conductor means. The flexible, elastic conductor means include first elastic conductor means 73, electrically and mechanically connected to and extending outwardly from the cathode base plate 33 toward the cathode back screen. By flexible and elastic is meant that the conductor means are yieldable to allow movement and yet elastic to allow a tight connection between the two pairs of elastic conductor means. In this way, electrical contact resistance is minimized.

The first elastic conductor means 73 are suitably joined to the backplate 31 by bolting or welding or the like.

Preferably, the elastic conductor means are fabricated of a material that is electroconductive and yet substantially resistant to attack by strongly basic alkali solutions, for example, copper. The first elastic conductor means 73 may be in the form of copper clips or copper snaps.

The second elastic conductor means 75 are provided in electrical contact with the bolt means 67. That is, according to a preferred exemplification of this invention, the second elastic conductor means 75 are joined to the bolt means 67, for example, by being bolted to the bolt means 67 or by having an aperture to fit over and around the bolt means 67 and to be in electrical contact therewith.

The second elastic conductor means 75 are on the opposite side of the cathode back screen 53 from the cathode fingers 55 and on the same side of the cathode back screen 53 as the cathode base plate 33, facing the cathode base plate 33 so as to engage the first electrical conductor means 73. In this way, the first electrical conductor means 73 and the second electrical conductor means 75 are in electrical contact with each other, providing a path for the flow of electrical current from the cathode base plate 31 through the catholyte chamber to the cathode back screen 53 and cathode fingers 55.

According to a further exemplification of this invention, there is provided a method of assembling a diaphragm electrolytic cell 1. The diaphragm electrolytic cell is characterized by presence of hollow cathode fingers 55 that extend outwardly from the cathode back screen 53. Each of the cathodes has an open base 65, side walls 57, a top edge 59, a bottom edge 61, and a leading edge 63 fabricated of a foraminous metal. The cathodes 55 and back screen 53 have a permeable diaphragm or permionic membrane thereon. The cell further includes an anode unit 41 with fingered anodes 43 that extend outwardly from an anode base plate 35.

Where the cathode side walls 57 of a pair of adjacent cathode fingers 55 are close together, e.g., less than 1 inch apart, it may be advantageous to apply the barrier, i.e., the permionic membrane or permeable diaphragm on the individual cathode fingers 55, and then assemble the fingers 55 to the back screen 53 to form a cathode unit 51. This may be accomplished using the anode 41 as a template as described below. The diaphragms or membranes may be pulled or installed in common on a wide pitch before installation in a narrow pitch cell, and may also be chemically or thermally treated in common on a wide pitch or individually before insertion in a cell, for example a cell of narrow pitch.

According to the method of this invention, individual cathode fingers 55 with bolt means 67 projecting outwardly from the open base 65 thereof and with either a permeable diaphragm or permionic membrane previously inserted thereon are inserted between a pair of adjacent anodes 43. Next, the cathode back screen 53 is positioned on a plane substantially defined by the open edges 65 of the individual fingered cathodes 55. The cathode back screen 53 is positioned on the plane such that the bolt means 67 pass through the first apertures 69 in the cathode back screen 53.

Next, the second elastic conductor means 75 are placed on the bolt means 67 on the opposite side of the back screen 53 from the hollow cathode fingers 55. Finally, the second elastic conductor means 75, the bolt means 67, the cathode back screen 53, and the cathode fingers 55, are bolted together to form a cathode unit and the anode unit 41 and the cathode unit 51 are assembled to form a single electrolytic diaphragm cell.

According to this method of the invention, the anode unit 41 is utilized as a template or die for the assembly of the cathode unit 51 so that the anode blades 43 determine the spacing and alignment of the hollow cathode fingers 55. According to this method of the invention, the anode unit 41 is utilized as a template, for example, by placing the anode unit 41 on a horizontal surface, such as a floor or work platform.

As used herein, the term anode unit includes the peripheral walls 25, the anodic base plate 35, and the anodes 43 installed therein and extending outwardly from the anodic base plate 35.

The adjacent anodes 43 may be single bladed in which case the cathode fingers 55 are between each pair of adjacent anode blades 43. Alternatively, the adjacent anodes may be double bladed in which case a single cathode finger 55 is installed between each pair of coated anode blades facing outwardly from the individual anodes. The cathodes are inserted between the anodes 43 with the leading edge 63 inward toward the anodic base plate 33 and the side walls 57 facing adjacent anodes 43.

The open base 65 of the cathodes 55 substantially define a plane. That is, by moving the hollow cathode fingers 55 back and forth away from and toward the anodic backplate 35 of the anodic unit 41, a plane can be formed.

After the cathodes 55 are positioned so as to define a plane, the diaphragm bearing cathode back screen 53 is positioned on the plane substantially defined by the open edges 65 at the bases of the individual diaphragm or membrane bearing hollow cathode fingers 55. In this way, the diaphragm or membrane bearing cathode back screen 53 is in contact with the diaphragm membrane bearing hollow cathode fingers 55 so that the back screen 53 can bear on the cathode fingers 55 and form an electrolyte tight seal between the diaphragm or membrane on the cathode back screen 53 and a diaphragm or membrane on the cathode fingers 55. The bolts 67 of the individual cathode fingers 55 pass through first apertures 69 in the back screen.

The elastic conductor means 75 are then placed onto the bolt means, for example, by sliding, bolting, welding, encircling, or the like. The elastic, flexible conductor means 75 are placed on the opposite side of the cathode back screen 53 from the cathodes 55, after the back screen 53 has been inserted on the cathodes 55 as described above with the bolt means 67 protruding through the apertures 75 in the cathode back screen 53.

The cathode back screen 53 is thereby slideably positioned and movable so as to allow proper alignment of the edges of the cathode back screen 53 with the peripheral walls 25 of the cell 1. Thereafter, the elastic conductor means 75, the bolt means 67, the cathode back screen 53, and the cathode fingers 55, are fastened to form a cathode unit 51. This may be done by bolting the assembly together so as to provide an electro-conductive bond between the elastic conductor 75 and the bolt means 67, and to provide a tight, electrolyte impermeable seal between the diaphragm or membrane bearing cathode back screen 53 and the diaphragm or membrane bearing cathode fingers 55.

After an electrolyte tight cathode unit 51 has been formed, the anode unit 41 and the cathode unit 51 may be assembled so as to form a single diaphragm electrolytic cell, for example, by placing the cathode base plate 35, which in a bipolar cell may also include the next anode unit 41, onto the cathode unit 51 so that the conductor means 73 on the backplate 35 elastically engage the conductor means 75 on the cathode unit 51. In this way, a bipolar electrolytic diaphragm cell may be provided.

While the invention has been described with reference to certain specific and illustrated embodiments, it is not intended to be so limited except insofar as it appears in the accompanying claims.

We claim:

1. In a diaphragm electrolytic cell having a plurality of fingered anode blades extending outwardly from an anode base plate and cathode means electrically and mechanically connected to a cathode base plate parallel to and spaced from said anode base plate, said cathode means comprising a cathode back screen spaced from, parallel to, and substantially co-extensive with said cathode base plate and plurality of hollow cathode fingers extending outwardly from said cathode back screen between said anode blades, each of said cathode fingers having an open base, and having side walls, a top, a bottom, and a leading edge fabricated of foraminous metal, the improvement comprising:

bolt means electrically and mechanically connected to each of said cathode fingers and extending outwardly from the open base thereof;

apertures in said cathode back screen corresponding to and of greater diameter than said bolt means whereby said cathode fingers are slideably adjustable; and first elastic electrical conductor means extending outwardly from the cathode base plate toward the cathode back screen and second elastic electrical conductor means in electrical contact with said bolt means, on the opposite side of said cathode back screen from the cathode fingers, said first electrical conductor means and said second electrical conductor means being in electrical contact with each other.

2. The electrolytic cell of claim 1 wherein the cathode base plate of the cell has an anode base plate of the next adjacent cell on the opposite surface thereof.

3. A method of assembling a diaphragm electrolytic cell having hollow fingered cathodes extending outwardly from a cathode back screen, each of said cathodes having an open base and having side walls, a top, a bottom, and a leading edge fabricated of foraminous metal, said cathodes and back screen being electrically and mechanically connected to a cathode base plate and having a permeable diaphragm thereon and said cell further having an anode unit with fingered anodes extending outwardly from an anode base plate, each of said anodes being interleaved between a pair of said cathodes, which method comprises:

inserting individual cathodes having bolt means projecting outwardly from the open base thereof between pairs of adjacent anodes;

positioning the cathode back screen on a plane substantially defined by the open bases of the individual fingered cathodes and passing the bolt means through apertures in the cathode back screen;

placing elastic conductor means onto said bolt means on the opposite side of the cathode back screen from the cathodes;

fastening the elastic conductor means, the bolt means, the back screen, and the cathode fingers together to form a cathode unit; and assembling the anode unit, the cathode unit, and the cathode base plate together with the elastic conductor means of said cathode unit co-operating with elastic conductor means extending from said cathode base plate so as to form a single electrolytic diaphragm cell.

4. The method of claim 3 wherein the cathode base of the cell has the anode base plate of the next adjacent cell on the opposite surface thereof.

5. The method of claim 3 wherein the diaphragm is installed on the cathodes at a wide pitch and the cathodes are thereafter installed in a cell of narrow pitch.

6. A method of assembling a diaphragm electrolytic cell having hollow fingered cathodes extending outwardly from a cathode back screen, each of said cathodes having an open base and having side walls, a top, a bottom, and a leading edge fabricated of foraminous metal, said cathodes and back screen being electrically and mechanically connected to a cathode base plate and having a permionic membrane thereon and said cell further having an anode unit with fingered anodes extending outwardly from an anode base plate, each of said anodes being interleaved between a pair of said cathodes, which method comprises:

inserting individual cathodes having bolt means projecting outwardly from the open base thereof between pairs of adjacent anodes;

positioning the cathode back screen on a plane substantially defined by the open bases of the individual fingered cathodes and passing the bolt means through apertures in the cathode back screen;

placing elastic conductor means onto said bolt means on the opposite side of the cathode back screen from the cathodes;

fastening the elastic conductor means, the bolt means, the back screen, and the cathode fingers together to form a cathode unit; and assembling the anode unit, the cathode unit, and the cathode base plate together with the elastic conductor means of said cathode unit co-operating with elastic conductor means extending from said cathode base plate so as to form a single electrolytic diaphragm cell.

7. The method of claim 6 wherein the cathode base of the cell has the anode base plate of the next adjacent cell on the opposite surface thereof.

8. The method of claim 6 wherein the permionic membrane is installed on the cathodes at a wide pitch and the cathodes are thereafter installed in a cell of narrow pitch.

9. In a diaphragm electrolytic cell having a plurality of fingered anode blades extending outwardly from an anode base plate and cathode means electrically and mechanically connected to a cathode base plate parallel to and spaced from said anode base plate, said cathode means comprising a cathode back screen spaced from and parallel to said cathode base plate and plurality of hollow cathode fingers extending outwardly from said cathode back screen between said anode blades, each of said cathode fingers having an open base, and having side walls, a top, a bottom, and a leading edge fabricated of foraminous metal, the improvement comprising:

bolt means electrically and mechanically connected to each of said cathode fingers and extending outwardly from the open base thereof;

apertures in said cathode back screen corresponding to and of greater diameter than said bolt means whereby said cathode fingers are slideably adjustable; and first elastic electrical conductor means extending outwardly from the cathode base plate toward the cathode back screen and second elastic electrical conductor means in electrical contact with said bolt means, on the opposite side of said cathode back screen from the cathode fingers, said first electrical conductor means and said second electrical conductor means being in electrical contact with each other.

10. The electrolytic cell of claim 9 wherein the cathode base plate of the cell has an anode base plate of the next adjacent cell on the opposite surface thereof.

* * * * *